United States Patent [19]

Fenster et al.

[11] 4,264,337

[45] Apr. 28, 1981

[54] PROCESS FOR FORMING A SCRUBBING PAD

[75] Inventors: Larry A. Fenster, Roslyn, N.Y.; Vincent F. Gudewicz, East Brunswick, N.J.

[73] Assignee: S. C. Johnson & Son, Inc., Racine, Wis.

[21] Appl. No.: 50,031

[22] Filed: Jun. 19, 1979

[51] Int. Cl.[3] ..... B24D 11/00

[52] U.S. Cl. ..... 51/295; 15/244 R; 51/296

[58] Field of Search ..... 51/294, 295, 296; 15/244 R, 244 C

[56] References Cited

U.S. PATENT DOCUMENTS

| | | | |
|---|---|---|---|
| 2,650,158 | 8/1953 | Eastman . | |
| 2,780,533 | 2/1957 | Hurst . | |
| 2,955,056 | 10/1960 | Krux . | |
| 3,005,219 | 10/1961 | Miller . | |
| 3,050,414 | 8/1962 | Reilly | 51/296 |
| 3,136,614 | 6/1964 | Kuzmick . | |
| 3,252,775 | 5/1966 | Tocci-Guilbert . | |
| 3,298,857 | 1/1967 | Terry . | |
| 3,463,745 | 8/1969 | Hofrichter et al. | 15/244 C |
| 3,626,023 | 12/1971 | Brizgys . | |
| 3,861,993 | 1/1975 | Guthrie . | |
| 3,940,513 | 2/1976 | Anderson . | |
| 4,011,063 | 3/1977 | Johnston . | |
| 4,055,029 | 10/1977 | Kalbow | 51/295 |
| 4,111,666 | 9/1978 | Kalbow | 51/295 |
| 4,119,594 | 10/1978 | Lobst et al. . | |
| 4,139,686 | 2/1979 | Jabs et al. | 15/244 C |
| 4,188,447 | 2/1980 | Ehlenz . | |

FOREIGN PATENT DOCUMENTS

| | | |
|---|---|---|
| 2616937 | 10/1977 | Fed. Rep. of Germany . |
| 2632545 | 1/1978 | Fed. Rep. of Germany . |
| 2210377 | 7/1974 | France . |

*Primary Examiner*—Donald E. Czaja
*Assistant Examiner*—W. Thompson

[57] ABSTRACT

An improved process for coating foamed sponge material with a heat curable adhesive and abrasive mixture which comprises using as the catalyst for the adhesive, a heat activatable catalyst which resists premature curing at room or ambient temperature, but which catalyzes the adhesive at elevated temperatures within five minutes.

3 Claims, No Drawings

PROCESS FOR FORMING A SCRUBBING PAD

This invention relates to a process for preparing a foam plastic pad or synthetic sponge having a scrubbing surface. In particular, it relates to a process employing a unique catalyst system for preparing the scrubbing pad.

Cleaning pads formed from pliable, flexible open or closed cell foams having a scrubbing surface of regular projections formed by making a series of intersecting cuts on the foam body are known to the art. Such pads, for example, are described in U.S. Pat. No. 3,707,012. Providing a scouring surface for such a body in the form of a particulate abrasive embedded in an adhesive has long been known to the art as illustrated in U.S. Pat. Nos. 3,073,716, 3,050,414 and 3,256,075. Employing as an abrasive material, hard urethane foam particles, useful in washing and cleaning products, is taught by Swiss Patent No. 534,202. To prevent undue weakening of the foam structure to reduce the tendency of the product to tear, the abrasive particles can be coated on the surfaces of the interstices of the structure, see U.S. Pat. No. 3,607,159 and French Patent No. 2,210,377. This procedure leaves the interstices relatively open and able to accept detergent and water for enhanced cleaning and scrubbing.

In U.S. Pat. No. 4,055,029 a grooved foam pad is said to be impregnated with a conventional synthetic plastics adhesive, such as a polyurethane two-component adhesive, admixed with a conventional comminuted hard foam plastic, such as polyurethane. The mixture is said to partially penetrate into the pores, but not significantly below the uppermost surface of the grooves and not into the root portion of the projections. However, in the improvement to the '029 patent, as described in U.S. Pat. No. 4,111,666, the patentee alleges that to prevent protuberances from being torn off in normal use, the adhesive should penetrate below the root portion of the projections. To accomplish this step, it is disclosed that coating rollers compress the foam pad and apply only adhesive, not abrasive, to permit the adhesive to be sucked inwards down to the roots of the projections. The adhesive must be at least partially hardened before further treatment. After hardening, a second coating step is performed wherein an abrasive-adhesive mix is surface coated to form a thin scouring surface containing abrasive.

Various problems have been encountered with the process to prepare products having an abrasive adhered to a sponge material by a polyurethane adhesive. As shown in the '666 patent, batches of two-component adhesive are prepared in a tank. The coating rollers rotate through the adhesive liquid and deposit a predetermined amount on the foam pad. Since it is inefficient to prepare individual portions of adhesive, large batches of adhesive are prepared sufficient to coat many sheets of foam over a period of one hour or more. Furthermore additional urethane reactants are fed to the adhesive batch. The new components contain fresh catalyst which accelerates the reaction of the urethane reactants previously contained in the adhesive batch.

A major problem has been uncovered during such processing. The typical liquid two-component polyurethane adhesive employed contains a liquid amine catalyst system. This system is highly sensitive to moisture and tends to cause significant premature curing (or hardening) of the adhesive prior to impregnation. The coating rollers tend to pick up a layer of cured resin and deposit it throughout the coating apparatus, thus fouling the system. After a relatively short time the coating system becomes inoperative, and thus impractical. Also moisture present in the air can react with the catalyzed composition to cause unwanted foaming. This problem is magnified by the need to allow the adhesive to at least partially harden before coating with an adhesive-abrasive mixture. However, if this process is not followed, then the patentee advises that the projections on the scrubbing surface described in the '029 patent, tear easily.

It is clear that there is a need for a process capable of impregnating an adhesive material unto the surface of a foam scrubbing pad, free of the defects and deficiencies of the prior art.

It is therefore an object of the present invention to provide a process for selectively impregnating a foam having a scrubbing portion with an adhesive composition containing an abrasive, which composition resists premature curing.

It is another object to prepare a strengthened open pore or reticulated foam having a scrubbing portion of regular projections, employing an impregnating composition of a polyurethane adhesive and optionally a finely comminuted abrasive.

The above and other objects are attained in a process for forming a flexible reticulated foam having a rigidified or strengthened scrubbing portion comprising:

(a) impregnating the foam to a depth below the scrubbing portion with a liquid, polyurethane adhesive composition adapted to harden during curing and (b) thereafter, curing the adhesive composition, wherein said adhesive composition contains a heat activatible catalyst normally in a solid state at ambient temperature, said catalyst decomposing during said curing and catalyzing the hardening of said adhesive. The resulting foam has a ridigified scouring surface which permits better scrubbing of utensils and the like. Typical flexible foams having an abrasive surface are well known to the art and are described in U.S. Pat. Nos. 3,707,012, 4,055,029, 4,111,666 and 2,650,158, among others. Such foams are also known as sponge scrubbers. The main body of the sponge scrubber is soft and either hydrophobic or hydrophilic in character. The scrubber side, which may be either provided with intersecting cuts to form a series of raised projections or bosses or left uncut, is impregnated with the adhesive abrasive mixture.

Enhanced scrubbing characteristics are imparted to the scrubbing surface by incorporating a finely comminuted conventional abrasive material. Although almost any abrasive material can be used, a preferred abrasive is prepared from a rigid, foamed polyurethane. Such a material is disclosed in Swiss Patent No. 534,202, and U.S. Pat. No. 4,055,029. Employing finely divided rigid polyrethane as the abrasive permits scrubbing of nonstick, Teflon coated cookware, which is easily scratched by other harder abrasives, yet provides a sufficiently abrasive surface to remove baked on food from cookware.

To add reinforcement to the scrubbing surface, an adhesive has been applied which also serves to disperse and carry the comminuted abrasive. The general technique for impregnating a foam or sponge with an adhesive composition optionally containing an abrasive is known to the art. In particular, the technique of roll coating an adhesive composition containing an abrasive is taught by U.S. Pat. No. 3,607,159, French Patent No. 2,210,377, and also U.S. Pat. No. 4,111,666.

The adhesive composition employed is applied in liquid form. It coats the surfaces of the foam to rigidify them upon curing or hardening. The adhesive is a polyurethane two-component adhesive. Such adhesives are known to the art and are disclosed in the text by K. J. Saunders, *Organic Polymer Chemistry,* published by Halsted Press, Chapter 14, pp. 318–345 and particularly pp. 342–345.

The three categories of urethane adhesives in use are the isocyanate-polyol systems, soluble elastomers and polyisocyanates. The two component urethane systems are isocyanate-polyol systems and pre-polymer polyol systems.

In the isocyanate-polyol system, the isocyanate and hydroxy-terminated polymer are mixed just prior to use. Typical isocyanates include isocyanates of low volatility such as diphenylmethylene diisocyanate and tolylene diisocyanate; and polyol adducts thereof. As the second component, polyesters and polyethers are generally employed.

In the prepolymer system, isocyanate terminated prepolymers are employed in place of the diisocyanates.

The adhesives will cure upon mixing the two urethane precursors without a catalyst; however, for commercial scale production, a catalyst is essential as the non-catalytic cure may take a day or longer. Systems which quickly cure without a catalyst are also difficult to use as the rate of cure is difficult to cure giving low pot life. Many other adhesive compositions typically employ a catalyst dissolved within the system. Such compositions begin to cure upon mixing the catalyst and precursors and have an unsatisfactory pot life, often less than 15 minutes. The term "pot life" is art-recognized and refers to the useful life of the composition at room temperature. In addition, such systems when exposed to moisture in the atmosphere, can also undergo undesired foaming. The presence of foamed urethane in the present process tends to foul the equipment and has a self-catalyzing effect on the adhesive.

The most widely used catalysts for isocyanate reactions are tertiary amines and certain metal compounds, particularly tin compounds. In the pre-polymer system of U.S. Pat. No. 4,111,666, a tertiary amine catalyst is employed. This tertiary amine catalyst and other metal catalysts are normally found in the liquid state, or are easily dissolved in the polyol-isocyanate batch, and subject the adhesive composition to premature curing after mixing and before application.

The problems associated with batch processing the foam sheets are also associated with the continuous processing of the sheets. In continuous processing the adhesive urethane precursors are mixed just before use under vigorous agitation. Thereafter they are extruded into a nip formed between a pair of rollers. By the time the adhesive works its way to the rollers at the bottom of the adhesive pool, the defects of premature curing are in evidence.

As noted previously, the present invention relates to the use of a heat activatable catalyst for the adhesive composition to provide adequate pot life combined with rapid cure. The catalyst must be in a physical state such that at room temperature and normal ambient operating temperatures, the catalyst does not enter into molecular interaction with the adhesive components. After impregnation onto the foam, the catalyst is activated by heating to a prescribed temperature to effect curing. The activation can occur either by melting the catalyst to allow intimate physical intermixing or by decomposition, which frees the active catalytic metal species.

In its broadest aspect the process provides for forming a foam having a rigidified scouring surface by impregnating the foam with an adhesive composition, which composition utilizes a heat activatable catalyst and thereafter curing the adhesive.

To form the flexible, reticulated foam with a strengthened scrubbing portion and containing an abrasive, the foam is first impregnated to a depth below its scrubbing portion with a liquid polyurethane adhesive composition having a heat activatable catalyst and having dispersed therein a particulate abrasive. Next, the impregnated adhesive is cured by activating the heat activatable catalyst.

Preferably the foam employed in the process is a polyurethane foam. The foam is in sheet or pillow form and may be either grooved by die cutting to obtain a waffle pattern to form a scrubbing portion, or have a planer surface. The term "scrubbing portion", as employed herein, therefore refers to the surface of the sponge which is impregnated with the adhesive and abrasive.

The liquid polyurethane adhesive employed is preferably a two-component isocyanate-polyol system. The preferred polyol precursor is a linear polyetherdiol. The preferred isocyanate precursor is 4,4'-diphenylmethane diisocyanate, or pre-polymers of this material. If desired, other conventional additives such as a pigment, surfactants, a thixotropic agent to control viscosity, stability and residual tack and/or a water scavenger may be employed.

The particulate abrasive is preferably formed by comminuting, using standard methods, a rigid polyurethane foam to a size passing through at least 20 and more preferably, 30–50 mesh. The hardness of the foam particles is preferably 2–3 on the Moh scale.

The heat activatable catalyst for the adhesive composition is metal salt, which is not easily dispersable in the pre-polymer mix. The catalyst is preferably in solid form at room temperature. Preferably the catalyst melts at a temperature from 150° F. to 250° F. The catalyst is most preferably employed in particulate form. The preferred catalyst particle size is less than 325 mesh.

As it is well known that metals such as zinc, cadmium, lead, tin and the like are active urethane catalysts, it is postulated that the metal cation of the catalyst is blocked by the anion to prevent premature curing.

The particularly preferred catalysts are the zinc alkanoates having from 8 to 18 carbon atoms, such as zinc octoate, zinc laurate, zinc palmitate, zinc stearate. The zinc catalysts are preferred because of the toxic nature of the other metal catalysts which prevent their use in a product for household kitchen use. The especially preferred catalyst is zinc stearate.

It has been found that the catalysts of the invention, for example, zinc stearate, can be added to a urethane adhesive premix. The resulting mix can be maintained in a fluid, unreacted, uncured state for on the order of one hour or longer. Upon heating to an elevated temperature beyond its melting point, and preferably 80° C. to 160° C., the catalyst immediately is activated to provide a complete cure within 3 to 5 minutes.

The urethane adhesive components are employed in conventional amounts. The catalyst provides enhanced results when employed in amounts from 0.1% to 1.0% based on the total weight of the mixture.

It is easy to determine if a particular catalyst is suitable for use in the present invention by mixing a conventional amount of catalyst into the urethane adhesive and observing the pot life. If the pot life in a beaker is below 60 minutes, the catalyst is not satisfactory. Further, the catalyst must cause the adhesive to cure within 5 minutes and preferably within 3 minutes upon heating to a temperature within the range of 80° to 160° C.

The components of the polyurethane adhesive are mixed according to known procedures. For example, for a typical urethane adhesive composition the polyol, pigment, abrasive, thixotropic agent (as fumed silica), scavenger and catalyst are blended sequentially with moderate agitation to form a uniform dispersion. Thereafter, the diisocyanate precursor is added to the resulting mix with vigorous agitation. The adhesive composition is then applied to coating rollers for impregnation of foam sheets.

Thereafter, the impregnated sheets of foam are heat cured in ovens to catalyze the adhesive composition and cure the adhesive. The cured sheets are cut into individual foam pads and packaged as desired.

The following Examples illustrate a somewhat preferred embodiment of the invention and are not limitative of scope.

EXAMPLE I

An adhesive composition is prepared by sequentially blending the following ingredients to produce a uniform dispersion:

(a) 529 parts by weight of a linear polyetherdiol, known as Multranol E9109, a product of Mobay Chemical.
(b) 169 parts by weight of blue pigment.
(c) 107 parts by weight of rigid polyurethane abrasive comminuted to a size passing through 20 mesh.
(d) 3.4 parts by weight fumed silica.
(e) 0.275 parts by weight zinc stearate catalyst, known as Formrez UL19, a product of Witco Chemical.

The resulting blend was vigorously agitated with 439 parts, 4,4′ diphenylmethane diisocyanate, known as Mondur PF, a product of Mobay Chemical, to form a heat activatable adhesive composition. The heat activatable adhesive exhibited a pot life of 2 hours in a beaker. When the quantity of catalyst was increased to 3.2 parts by weight, and the resulting batch applied to foam sheets employing a coating roller, the pot life on the coating roller was on the order of 1½ hours. The weight of ingredients is based on the total weight of adhesive composition.

COMPARATIVE EXAMPLE I

Adhesive compositions were prepared according to Example I with the exception that the catalyst employed was (i) 0.275 parts of a tertiary amine catalyst, Desmorappid D709, a liquid catalyst of Mobay Chemical, and (ii) 0.275 of Dabco 33LV, a tertiary amine catalyst, which is a product of Mobay Chemical.

The pot life in a beaker of the aforesaid compositions was 32 minutes for the Desmorappid D709 and 40 minutes for the Dabco 33LV.

Although the invention has been described in detail by referring to certain preferred embodiments, it will be understood that various modifications can be made within the spirit and scope of the invention. This invention is not to be limited except as set forth in the following claims.

I claim:

1. A process for forming a flexible foam having a strengthened scrubbing portion comprising:

(a) impregnating one surface of the foam to a depth below the scrubbing portion with a liquid, polyurethane adhesive composition and
(b) thereafter, curing the adhesive composition, wherein said adhesive composition contains a heat activatable catalyst, normally in a solid state at ambient temperature, which resists premature curing, said catalyst being activated during said curing and catalyzing the hardening of said adhesive wherein the catalyst is a zinc alkanoate having from 8 to 18 carbon atoms.

2. The process of claim 1 wherein the adhesive composition has a particulate abrasive dispersed therein.

3. The process of claim 1 wherein the catalyst is zinc stearate.

* * * * *